US010818135B2

(12) United States Patent
Baerlocher et al.

(10) Patent No.: US 10,818,135 B2
(45) Date of Patent: Oct. 27, 2020

(54) WAGERING GAME SYSTEM WITH PERSISTENT ENTRIES IN COMMUNITY EVENT

(71) Applicant: Bally Gaming, Inc., Las Vegas, NV (US)

(72) Inventors: Anthony Baerlocher, Henderson, NV (US); Jeremy Hornik, Chicago, IL (US)

(73) Assignee: SG Gaming, Inc., Las Vegas, NV (US)

( * ) Notice: Subject to any disclaimer, the term of this patent is extended or adjusted under 35 U.S.C. 154(b) by 563 days.

(21) Appl. No.: 15/246,068

(22) Filed: Aug. 24, 2016

(65) Prior Publication Data

US 2017/0061732 A1 Mar. 2, 2017

Related U.S. Application Data

(60) Provisional application No. 62/212,707, filed on Sep. 1, 2015.

(51) Int. Cl.
*G07F 17/32* (2006.01)

(52) U.S. Cl.
CPC ..... *G07F 17/3244* (2013.01); *G07F 17/322* (2013.01); *G07F 17/3209* (2013.01); *G07F 17/3211* (2013.01); *G07F 17/3272* (2013.01)

(58) Field of Classification Search
None
See application file for complete search history.

(56) References Cited

U.S. PATENT DOCUMENTS

| | | | |
|---|---|---|---|
| 5,393,057 | A | 2/1995 | Marnell, II |
| 5,560,603 | A | 10/1996 | Seeling |
| 5,580,309 | A | 12/1996 | Piechowiak |
| 5,664,998 | A | 9/1997 | Seeling |
| 5,772,509 | A | 6/1998 | Weiss |
| 5,779,544 | A | 7/1998 | Seeling |
| 5,976,015 | A | 11/1999 | Seeling |
| 5,997,400 | A | 12/1999 | Seeling |
| 6,012,982 | A | 1/2000 | Piechowiak |
| 6,068,553 | A | 5/2000 | Parker |
| 6,077,162 | A | 6/2000 | Weiss |
| 6,110,043 | A | 8/2000 | Olsen |
| 6,210,275 | B1 | 4/2001 | Olsen |
| 6,217,448 | B1 | 4/2001 | Olsen |

(Continued)

FOREIGN PATENT DOCUMENTS

AU 200245837 B2 12/2002

*Primary Examiner* — Damon J Pierce

(57) ABSTRACT

A game machine includes a table display defining a first portion on which a community game is displayed and second portions on which a wagering game is displayed to player stations. An outcome is displayed on the second portions. An entry into the community game is awarded to the player station in response to a first triggering event. The entry is applied to a game element of the community game in association with the player station, which persists with the game element for a plurality of plays of the community game. Responsive to a second triggering event, a play of the community game is conducted and an award is awarded to any player station having an entry applied to a game element in the community game responsive to an outcome of a play of the community game that is associated with the game element to which the entry is applied.

18 Claims, 12 Drawing Sheets

(56) References Cited

U.S. PATENT DOCUMENTS

| | | | |
|---|---|---|---|
| 6,224,484 | B1 | 5/2001 | Okuda |
| 6,309,299 | B1 | 10/2001 | Weiss |
| 6,315,660 | B1 | 11/2001 | DeMar |
| 6,364,314 | B1 | 4/2002 | Canterbury |
| 6,364,766 | B1 | 4/2002 | Anderson |
| 6,375,567 | B1 | 4/2002 | Acres |
| 6,375,568 | B1 | 4/2002 | Roffman |
| 6,439,995 | B1 | 8/2002 | Hughs-Baird |
| 6,511,375 | B1 | 1/2003 | Kaminkow |
| 6,585,591 | B1 | 7/2003 | Baerlocher |
| 6,595,854 | B2 | 7/2003 | Hughs-Baird |
| 6,609,973 | B1 | 8/2003 | Weiss |
| 6,648,753 | B1 | 11/2003 | Tracy |
| 6,656,046 | B1 | 12/2003 | Yoseloff |
| 6,692,354 | B2 | 2/2004 | Tracy |
| 6,780,110 | B2 | 8/2004 | Baerlocher |
| 6,786,824 | B2 | 9/2004 | Cannon |
| 6,800,002 | B2 | 10/2004 | Katayama |
| 6,802,775 | B2 | 10/2004 | Baerlocher |
| 6,837,793 | B2 | 1/2005 | McClintic |
| 6,869,361 | B2 | 3/2005 | Sharpless |
| 6,932,701 | B2 | 8/2005 | Glavich |
| 6,986,710 | B2 | 1/2006 | Baerlocher |
| 7,008,324 | B1 | 3/2006 | Johnson |
| 7,077,744 | B2 | 7/2006 | Cannon |
| 7,104,886 | B2 | 9/2006 | Baerlocher |
| 7,160,190 | B2 | 1/2007 | Baerlocher |
| 7,169,041 | B2 | 1/2007 | Tessmer |
| 7,182,689 | B2 | 2/2007 | Hughs-Baird |
| 7,192,344 | B2 | 3/2007 | Baerlocher |
| 7,273,415 | B2 | 9/2007 | Cregan |
| 7,303,469 | B2 | 12/2007 | Kaminkow |
| 7,311,598 | B2 | 12/2007 | Kaminkow |
| 7,311,604 | B2 | 12/2007 | Kaminkow |
| 7,314,408 | B2 | 1/2008 | Cannon |
| 7,331,865 | B2 | 2/2008 | Baerlocher |
| 7,393,280 | B2 | 7/2008 | Cannon |
| 7,427,236 | B2 | 9/2008 | Kaminkow |
| 7,448,949 | B2 | 11/2008 | Kaninkow |
| 7,455,588 | B2 | 11/2008 | Webb |
| 7,500,913 | B2 | 3/2009 | Baerlocher |
| 7,544,129 | B2 | 6/2009 | Baerlocher |
| 7,566,271 | B2 | 7/2009 | Hostetler |
| 7,585,218 | B2 | 9/2009 | Mead |
| 7,614,948 | B2 | 11/2009 | Saffari |
| 7,654,896 | B2 | 2/2010 | Baerlocher |
| 7,662,040 | B2 | 2/2010 | Englman |
| 7,666,092 | B2 | 2/2010 | Kaminkow |
| 7,690,977 | B2 | 4/2010 | Cuddy |
| 7,713,124 | B2 | 5/2010 | Cuddy |
| 7,731,581 | B2 | 6/2010 | Chamberlain |
| 7,758,423 | B2 | 7/2010 | Foster |
| 7,771,270 | B2 | 8/2010 | Kaminkow |
| 7,775,873 | B2 | 8/2010 | Aoki |
| 7,780,531 | B2 | 8/2010 | Englman |
| 7,789,755 | B2 | 9/2010 | Davis |
| 7,824,267 | B2 | 11/2010 | Cannon |
| 7,828,649 | B2 | 11/2010 | Cuddy |
| 7,833,094 | B2 | 11/2010 | Englman |
| 7,841,938 | B2 | 11/2010 | Gatto |
| 7,874,912 | B2 | 1/2011 | Cregan |
| 7,883,403 | B2 | 2/2011 | Low |
| 7,892,088 | B2 | 2/2011 | Brandstetter |
| 7,896,734 | B2 | 3/2011 | Kaminkow |
| 7,901,282 | B2 | 3/2011 | Cannon |
| 7,931,530 | B2 | 4/2011 | Anderson |
| 7,946,915 | B2 | 5/2011 | Cannon |
| 7,951,004 | B2 | 5/2011 | Saffari |
| 7,959,507 | B2 | 6/2011 | Cannon |
| 7,959,509 | B2 | 6/2011 | Saffari |
| 7,976,389 | B2 | 7/2011 | Cannon |
| 7,980,943 | B2 | 7/2011 | McGlone |
| 7,980,954 | B2 | 7/2011 | Gagner |
| 8,033,912 | B2 | 10/2011 | Cannon |
| 8,057,294 | B2 | 11/2011 | Pacey |
| 8,057,295 | B2 | 11/2011 | Vann |
| 8,057,308 | B2 | 11/2011 | Kaminkow |
| 8,070,587 | B2 | 12/2011 | Davis |
| 8,070,593 | B2 | 12/2011 | DeWaal |
| 8,087,995 | B2 | 1/2012 | Englman |
| 8,100,754 | B2 | 1/2012 | Bigelow, Jr. |
| 8,100,760 | B2 | 1/2012 | Cannon |
| 8,109,821 | B2 | 2/2012 | Kovacs |
| 8,113,947 | B2 | 2/2012 | Hornik |
| 8,123,610 | B2 | 2/2012 | Hornik |
| 8,147,316 | B2 | 4/2012 | Arezina |
| 8,172,685 | B2 | 5/2012 | Englman |
| 8,172,687 | B2 | 5/2012 | Gagner |
| 8,192,279 | B2 | 6/2012 | Saffari |
| 8,197,326 | B2 | 6/2012 | Chamberlain |
| 8,197,331 | B2 | 6/2012 | Pacey |
| 8,202,156 | B2 | 6/2012 | Bartholomew |
| 8,210,929 | B2 | 7/2012 | Baerlocher |
| 8,216,061 | B2 | 7/2012 | Pacey |
| 8,235,785 | B2 | 8/2012 | Thomas |
| 8,246,472 | B2 | 8/2012 | Kaminkow |
| 8,262,456 | B2 | 9/2012 | Englman |
| 8,267,774 | B2 | 9/2012 | Englman |
| 8,292,719 | B2 | 10/2012 | Englman |
| 8,292,720 | B2 | 10/2012 | Davis |
| 8,292,731 | B2 | 10/2012 | Collette |
| 8,303,394 | B2 | 11/2012 | Englman |
| 8,303,402 | B2 | 11/2012 | Aoki |
| 8,313,368 | B2 | 11/2012 | Filipour |
| 8,317,603 | B2 | 11/2012 | Anderson |
| 8,342,927 | B2 | 1/2013 | Englman |
| 8,348,747 | B2 | 1/2013 | Arezina |
| 8,371,919 | B2 | 2/2013 | Hornik |
| 8,382,572 | B2 | 2/2013 | Hoffman |
| 8,388,435 | B2 | 3/2013 | Anderson |
| 8,393,948 | B2 | 3/2013 | Allen |
| 8,403,740 | B2 | 3/2013 | Kovacs |
| 8,403,758 | B2 | 3/2013 | Hornik |
| 8,409,014 | B2 | 4/2013 | Gagner |
| 8,419,549 | B2 | 4/2013 | Kaminkow |
| 8,425,323 | B2 | 4/2013 | Fiden |
| 8,430,738 | B2 | 4/2013 | Cannon |
| 8,435,120 | B2 | 5/2013 | Hornik |
| 8,444,480 | B2 | 5/2013 | Baerlocher |
| 8,460,087 | B2 | 6/2013 | Michel |
| 8,460,109 | B2 | 6/2013 | Bryson |
| 8,496,519 | B2 | 7/2013 | Hoffman |
| 8,512,147 | B2 | 8/2013 | Aoki |
| 8,517,810 | B2 | 8/2013 | Vann |
| 8,545,314 | B2 | 10/2013 | Bartholomew |
| 8,574,066 | B2 | 11/2013 | Cannon |
| 8,579,709 | B2 | 11/2013 | Saffari |
| 8,585,485 | B2 | 11/2013 | Guinn |
| 8,585,489 | B2 | 11/2013 | Cannon |
| 8,585,492 | B2 | 11/2013 | Barclay |
| 8,597,103 | B2 | 12/2013 | Bigelow, Jr. |
| 8,602,865 | B2 | 12/2013 | Zielinski |
| 8,608,542 | B2 | 12/2013 | Davis |
| 8,613,650 | B2 | 12/2013 | Kovacs |
| 8,622,812 | B2 | 1/2014 | Englman |
| 8,622,814 | B2 | 1/2014 | Englman |
| 8,628,407 | B2 | 1/2014 | Arezina |
| 8,672,739 | B2 | 3/2014 | Filipour |
| 8,684,826 | B2 | 4/2014 | Englman |
| 8,684,832 | B2 | 4/2014 | Saffari |
| 8,690,658 | B2 | 4/2014 | Pacey |
| 8,696,424 | B1 | 4/2014 | Nicely |
| 8,696,445 | B2 | 4/2014 | Englman |
| 8,702,487 | B2 | 4/2014 | Thomas |
| 8,702,508 | B2 | 4/2014 | Gura |
| 8,721,436 | B2 | 5/2014 | Hamlin |
| 8,727,865 | B2 | 5/2014 | Filipour |
| 8,747,219 | B2 | 6/2014 | Wright |
| 8,753,188 | B2 | 6/2014 | Cannon |
| 8,758,120 | B2 | 6/2014 | Wright |
| 8,758,123 | B2 | 6/2014 | Frattinger |
| 8,764,537 | B2 | 7/2014 | Jaffe |
| 8,777,712 | B2 | 7/2014 | Baerlocher |
| 8,777,722 | B2 | 7/2014 | Caputo |

(56) References Cited

U.S. PATENT DOCUMENTS

| | | | | |
|---|---|---|---|---|
| 8,784,216 | B2 | 7/2014 | Thomas | |
| 8,795,057 | B2 | 8/2014 | Hoffman | |
| 8,821,249 | B2 | 9/2014 | Gomez | |
| 8,827,805 | B1 | 9/2014 | Caporusso | |
| 8,876,592 | B2 | 11/2014 | Gomez | |
| 8,882,585 | B2 | 11/2014 | Cannon | |
| 8,888,580 | B2 | 11/2014 | Caputo | |
| 8,888,587 | B2 | 11/2014 | Burke | |
| 8,926,421 | B2 | 1/2015 | Arezina | |
| 8,968,071 | B2 | 3/2015 | Tessmer | |
| 8,968,083 | B2 | 3/2015 | Nicely | |
| 8,979,625 | B2 | 3/2015 | Englman | |
| 8,979,635 | B2 | 3/2015 | Vann | |
| 8,979,657 | B2 | 3/2015 | Englman | |
| 8,986,095 | B2 | 3/2015 | Englman | |
| 9,005,015 | B2 | 4/2015 | Baerlocher | |
| 9,011,225 | B2 | 4/2015 | Brown | |
| 9,011,226 | B2 | 4/2015 | Montano | |
| 9,011,251 | B2 | 4/2015 | Aoki | |
| 9,033,791 | B2 | 5/2015 | Hamlin | |
| 9,039,507 | B2 | 5/2015 | Allen | |
| 9,039,511 | B2 | 5/2015 | DeWaal | |
| 9,070,246 | B2 | 6/2015 | Fiden | |
| 9,082,257 | B2 | 7/2015 | Caputo | |
| 2006/0046822 | A1* | 3/2006 | Kaminkow | G07F 17/32 463/16 |
| 2006/0079316 | A1 | 4/2006 | Flemming | |
| 2006/0079317 | A1 | 4/2006 | Flemming | |
| 2007/0298856 | A1 | 12/2007 | Gilmore | |
| 2008/0293478 | A1 | 11/2008 | Anderson | |
| 2009/0253483 | A1* | 10/2009 | Pacey | G07F 17/32 463/20 |
| 2009/0275411 | A1* | 11/2009 | Kisenwether | G06Q 10/10 463/42 |
| 2012/0184351 | A1 | 7/2012 | Hornik | |
| 2012/0231868 | A1* | 9/2012 | Guinn | G07F 17/3274 463/20 |
| 2013/0165215 | A1* | 6/2013 | Arezina | G07F 17/3206 463/25 |
| 2015/0262457 | A1* | 9/2015 | Jhanb | G07F 17/3213 463/20 |

* cited by examiner

WAGERING GAME SYSTEM WITH PERSISTENT ENTRIES IN COMMUNITY EVENT

CROSS-REFERENCE TO RELATED APPLICATION

This application claims the benefit of U.S. Provisional Application No. 62/212,707, filed Sep. 1, 2015, which is hereby incorporated by reference herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming systems, apparatus, and methods and, more particularly, to gaming systems, apparatus and methods relating to regulated wagering games implemented on systems and machines resident in a wagering establishment licensed by a local gaming control board.

BACKGROUND OF THE INVENTION

The gaming industry depends upon player participation. Players are generally "hopeful" players who either think they are lucky or at least think they can get lucky—for a relatively small investment to play a game, they can get a disproportionately large return. To create this feeling of luck, a gaming apparatus relies upon an internal or external random element generator to generate one or more random elements such as random numbers. The gaming apparatus determines a game outcome based, at least in part, on the one or more random elements.

A significant technical challenge is to improve the operation of gaming apparatus and games played thereon, including the manner in which they leverage the underlying random element generator, by making them yield a negative return on investment in the long run (via a high quantity and/or frequency of player/apparatus interactions) and yet random and volatile enough to make players feel they can get lucky and win in the short run. Striking the right balance between yield versus randomness and volatility to create a feeling of luck involves addressing many technical problems, some of which can be at odds with one another. This luck factor is what appeals to core players and encourages prolonged and frequent player participation. As the industry matures, the creativity and ingenuity required to improve such operation of gaming apparatus and games grows accordingly.

SUMMARY OF THE INVENTION

According to one aspect of the present invention, a casino wagering game system primarily dedicated to playing a casino wagering game and a community game includes a first electronic display device configured to display the community game and a plurality of player stations, primarily dedicated to playing the wagering game and the community game, communicatively coupled to the first electronic display device, each player station comprising a second electronic display device and one or more electronic input devices. The casino wagering game system also includes game-logic circuitry configured to, for each of the plurality of player stations, detect, via at least one of the one or more electronic input devices, a physical item associated with a monetary value that establishes a credit balance for the player station and initiate the casino wagering game at the player station in response to an input indicative of a wager covered by the credit balance to cause the display of a randomly determined wagering game outcome on the second electronic display device. The game-logic circuitry is also configured to award an entry to the player station in the community game in response to a first triggering event and apply the entry to one or more game elements of the community game in association with the player station, the entry persisting with the one or more game elements for a plurality of plays of the community game. The game-logic circuitry is also configured to receive, via at least one of the one or more electronic input devices, a cashout input for the player station that initiates a payout from the credit balance for the player station. The game-logic circuitry is also configured to conduct a play of the community game in response to a second triggering event and to award an award to any player station having an entry applied to a game element in the community game responsive to an outcome of a play of the community game that is associated with the game element to which the entry is applied.

According to another aspect of the invention, a computer-implemented method in a gaming system comprises a gaming system comprising game-logic circuitry, at least one electronic display device, one or more electronic input devices, and a plurality of player stations, each player station primarily dedicated to playing at least one respective regulated casino wagering game and configured to participate in a community game. The method implemented by this gaming system comprising the acts of detecting, via at least one of the one or more electronic input devices at the respective player station, a physical item associated with a monetary value that establishes a credit balance and initiating the casino wagering game at the respective player station in response to an input indicative of a wager covered by the credit balance. The method implemented by this gaming system further comprises the acts by the game-logic circuitry of awarding an entry to one of the player stations in response to a first triggering event and applying the entry to a game element of the community game, the entry persisting with the game element for a plurality of plays of the community game. The method further includes the acts by the game-logic circuitry of conducting a play of the community game in response to a second triggering event and awarding an award to the one of the player stations in response to the play of the community game resulting in an outcome associated with the game element to which the entry is applied. The method further includes the acts by the game-logic circuitry of receiving, via at least one of the one or more electronic input devices of the respective gaming machine, a cashout input that initiates a payout from the credit balance.

In yet another aspect of the present concepts, a casino wagering game machine primarily dedicated to playing a casino wagering game and a community game includes a first electronic display device configured to display the community game, the first electronic display device comprising an electronic table, and a plurality of player stations, primarily dedicated to playing the wagering game and the community game. Each player station comprises a second electronic display device and one or more electronic input devices, the second electronic display device of each of the plurality of player stations comprises an allocated region of the electronic table. The casino wagering game machine also comprises game-logic circuitry configured to, for each of the plurality of player stations, detect, via at least one of the one or more electronic input devices, a physical item associated with a monetary value that establishes a credit balance for the player station and initiate the casino wagering game at the player station in response to an input indicative of a wager covered by the credit balance to cause the display of a randomly determined wagering game outcome on the second electronic display device. The game-logic circuitry is also configured to award an entry to the player station in the community game in response to a first triggering event and to apply the entry to one or more game elements of the community game in association with the player station, the entry persisting with the one or more game elements for a plurality of plays of the community game. The game-logic circuitry is also configured to receive, via at least one of the one or more electronic input devices, a cashout input for the player station that initiates a payout from the credit balance for the player station. The game-logic circuitry is also configured to conduct a play of the community game in response to a second triggering event and to award an award to any player station having an entry applied to a game element in the community game responsive to an outcome of a play of the community game that is associated with the game element to which the entry is applied.

Additional aspects of the invention will be apparent to those of ordinary skill in the art in view of the detailed description of various embodiments, which is made with reference to the drawings, a brief description of which is provided below.

Figure 1:
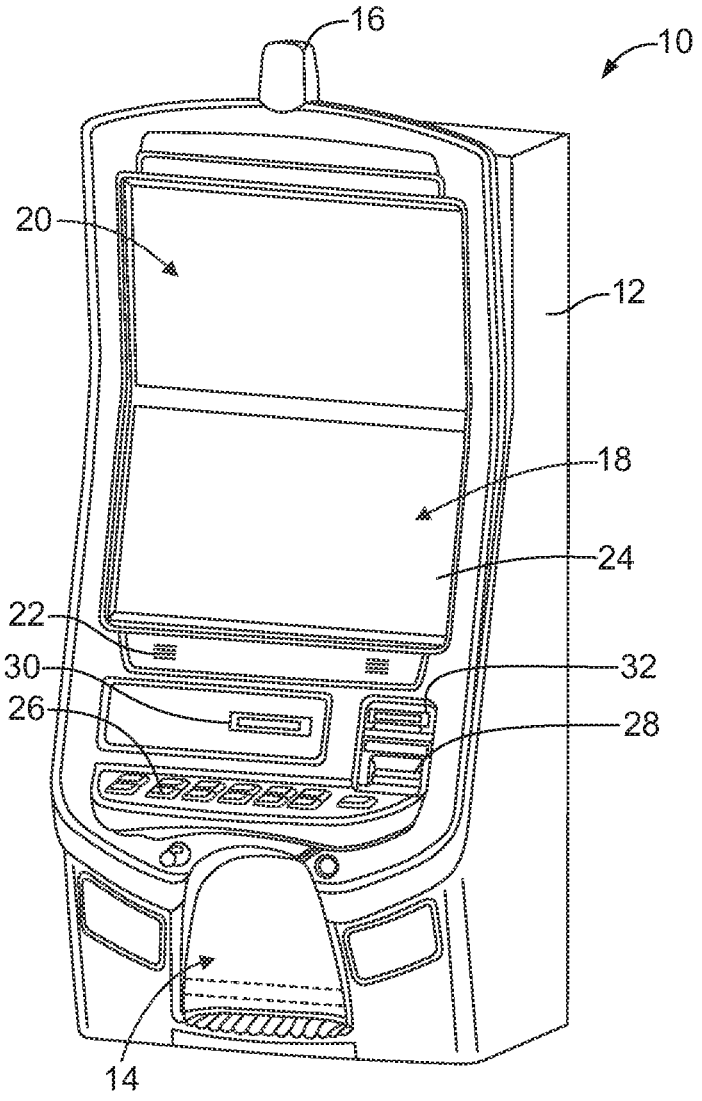
FIG. 1 is a perspective view of a free-standing gaming machine according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming machine 10 similar to those operated in gaming establishments, such as casinos. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing models as shown, handheld mobile units, bartop models, workstation-type console models, etc. Further, the gaming machine 10 may be primarily dedicated for use in playing wagering games, or may include non-dedicated devices, such as mobile phones, personal digital assistants, personal computers, etc. Exemplary types of gaming machines are disclosed in U.S. Pat. Nos. 6,517,433, 8,057,303, and 8,226,459, which are incorporated herein by reference in their entireties.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. The cabinet 12 forms an alcove 14 configured to store one or more beverages or personal items of a player. A notification mechanism 16, such as a candle or tower light, is mounted to the top of the cabinet 12. It flashes to alert an attendant that change is needed, a hand pay is requested, or there is a potential problem with the gaming machine 10.

The input devices, output devices, and input/output devices are disposed on, and securely coupled to, the cabinet 12. By way of example, the output devices include a primary display 18, a secondary display 20, and one or more audio speakers 22. The primary display 18 or the secondary display 20 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary or secondary displays, buttons 26 on a button panel, a bill/ticket acceptor 28, a card reader/writer 30, a ticket dispenser 32, and player-accessible ports (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

The player input devices, such as the touch screen 24, buttons 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. In order to deposit cash or credits onto the gaming machine 10, the value input devices are configured to detect a physical item associated with a monetary value that establishes a credit balance on a credit meter such as the "credits" meter 84 (see FIG. 3). The physical item may, for example, be currency bills, coins, tickets, vouchers, coupons, cards, and/or computer-readable storage mediums. The deposited cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. In response to a cashout input that initiates a payout from the credit balance on the "credits" meter 84 (see FIG. 3), the value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Figure 2:
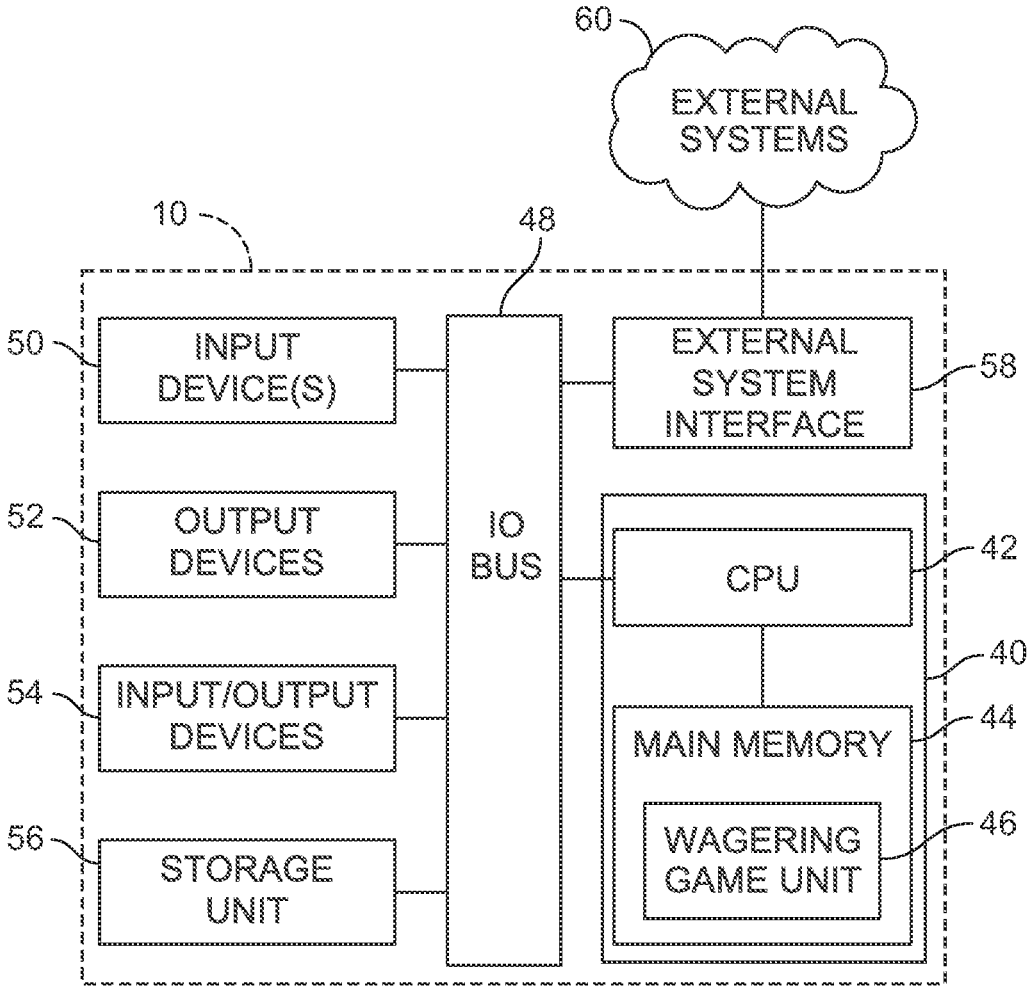
FIG. 2 is a schematic view of a gaming system according to an embodiment of the present invention.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video black jack, video slots, video lottery, etc., in whole or part.

The game-logic circuitry 40 is also connected to an input/output (I/O) bus 48, which can include any suitable bus technologies, such as an AGTL+frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compare it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use. In other words, through the use of the authentication program, the game-logic circuitry facilitates operation of the game in a way that a person making calculations or computations could not.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human and is integral to operating the game.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
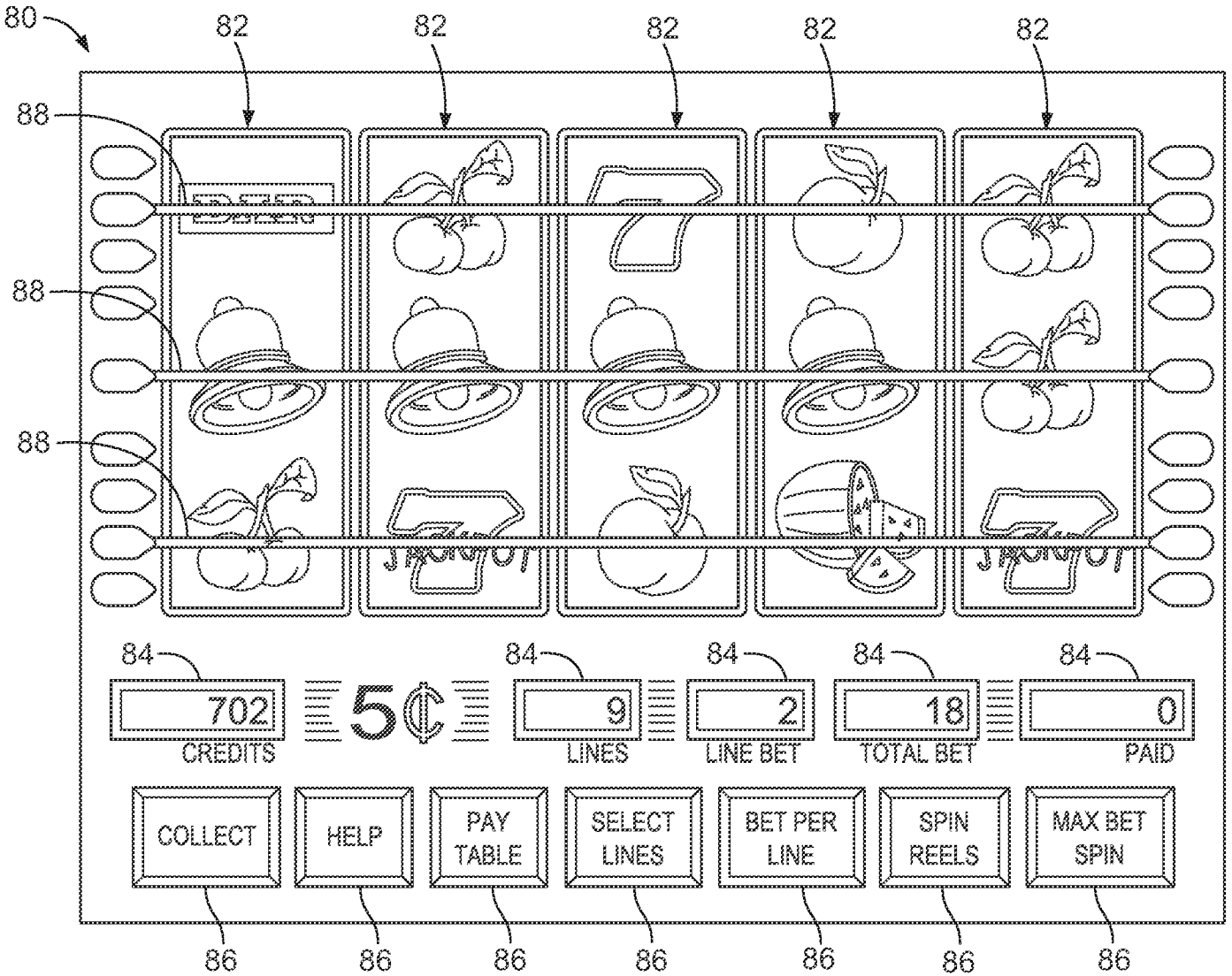
FIG. 3 is an image of an exemplary basic-game screen of a wagering game displayed on a gaming machine, according to an embodiment of the present invention.

Referring now to FIG. 3, there is illustrated an image of a basic-game screen 80 adapted to be displayed on the primary display 18 or the secondary display 20. The basic-game screen 80 portrays a plurality of simulated symbol-bearing reels 82. Alternatively or additionally, the basic-game screen 80 portrays a plurality of mechanical reels or other video or mechanical presentation consistent with the game format and theme. The basic-game screen 80 also advantageously displays one or more game-session credit meters 84 and various touch screen buttons 86 adapted to be actuated by a player. A player can operate or interact with the wagering game using these touch screen buttons or other input devices such as the buttons 26 shown in FIG. 1. The game-logic circuitry 40 operates to execute a wagering-game program causing the primary display 18 or the secondary display 20 to display the wagering game.

In response to receiving an input indicative of a wager covered by or deducted from the credit balance on the "credits" meter 84, the reels 82 are rotated and stopped to place symbols on the reels in visual association with paylines such as paylines 88. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18 or secondary display 20) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

Figure 4A:
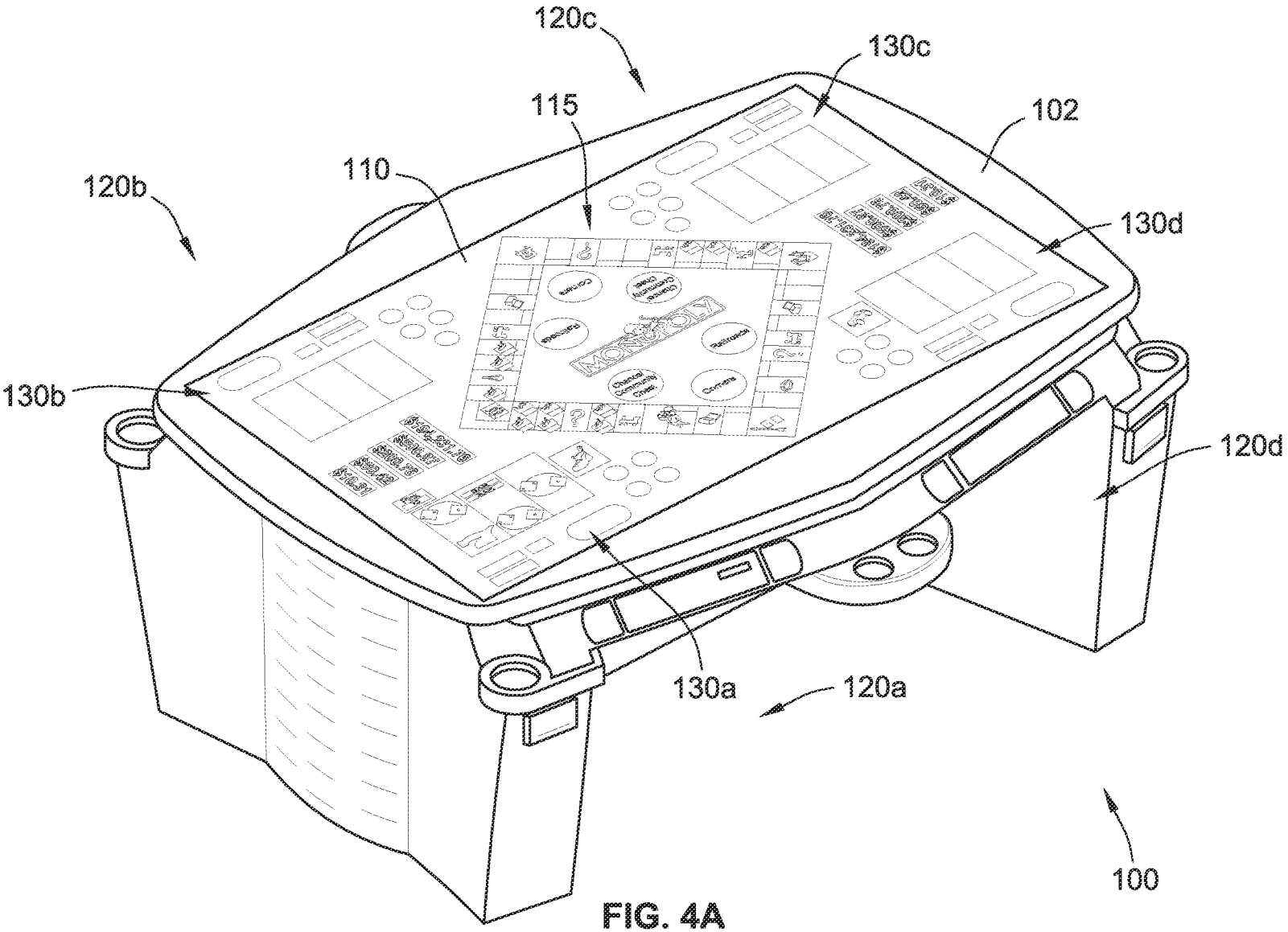
FIG. 4A shows a table-based embodiment of a wagering game system adapted to enable conduct of a wagering game and participation in a community event in accord with at least some aspects of the present concepts.

FIG. 4A shows one embodiment of a casino wagering game system 100 comprising a wagering game machine 102 in accord with at least some aspects of the present concepts that is primarily dedicated to playing at least one regulated casino wagering game and at least one community game. The wagering game machine 102 depicted in FIG. 4A includes one or more electronic display devices configured to support social game play amongst a plurality of player stations 120*a*-120*d* (four as shown) each having its own display device(s) 130*a*-130*d* enabling the player at the respective player station to play a regulated casino wagering game. In the example depicted in FIG. 4A, the player station display devices 130*a*-130*d* are sub-portions of a game system 100 display device 110 (e.g., a 65" 4K resolution primary display table with full touch screen capability (e.g., 100 point, etc.)) configured to display a community game 115 for the player stations 120*a*-120*d*.

Figure 4B:
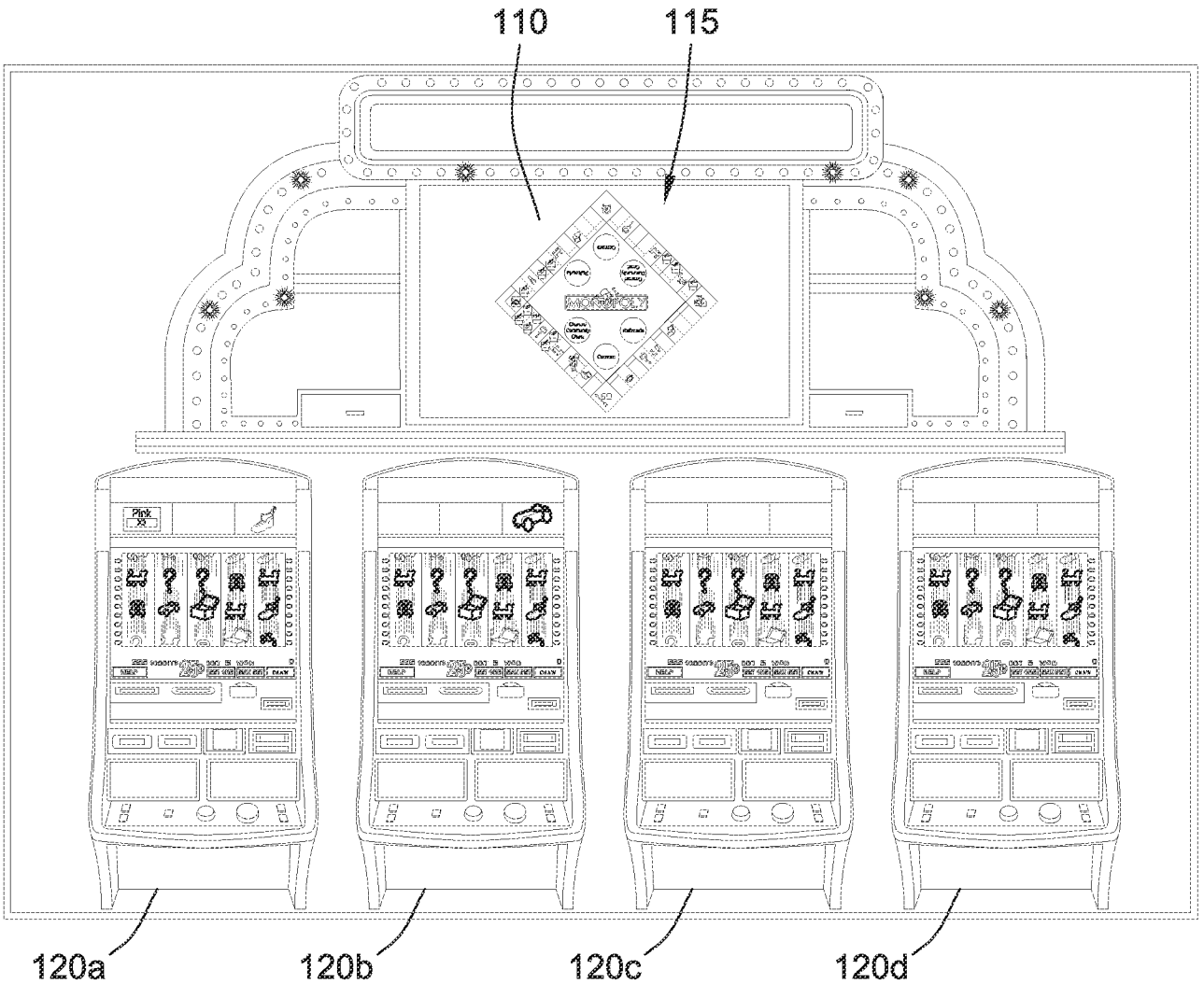
FIG. 4B shows a bank of wagering game machines adapted to enable conduct of a wagering game and participation in a community event in accord with at least some aspects of the present concepts.

Although the example of FIG. 4A utilizes a single table display 110 displaying both the community game 115 in a central portion of the table display, together with the player station displays 130*a*-130*d*, the wagering game machine 102 may alternately comprise a display device for the community game that is separate from the player station display devices. For example, the wagering game machine 102 of FIG. 4A could comprise five separate display devices, a central display device for the community game and four player station display devices. In yet other embodiments, the wagering game system 100 display device 110 comprises a community display disposed to be viewed by player stations 120*a*-120*d*, such as wagering game machines (e.g., slot machines, as shown in FIG. 4B) or portable (e.g., handheld) wagering game devices (not shown) configured to conduct the casino wagering game. Examples of suitable portable wagering game devices are shown in U.S. Pat. No. 8,858,332, which is incorporated by reference in its entirety herein. In any of the above embodiments, one or more area displays (e.g., a wall display) may be disposed within the casino, and/or the immediate game environment of the wagering game system 100, to synchronously display the community game to attract players to the wagering game system and to allow mobile players (e.g., playing in a lounge setting) to view the game on a large display.

It is to be noted that a vertical position of the wagering game machine 102 display device 110 shown in FIG. 4A may be selected to accommodate seated play (seats not shown in FIG. 4A) or, optionally, standing play.

The physical design of the game machine 102 of FIG. 4A comprises four distinct player stations 120*a*-120*d*, each including one or more electronic input devices (not shown) such as, but not limited to, a value input device, player controls such as a touch panel or one or more physical push-buttons, betting interface(s), and the like. Each of the player stations 120*a*-120*d* also includes its own display(s) 130*a*-130*d* configured to display, for example, the casino wagering game and any appurtenant game meters(s) or game information. The value input device, as noted above, is configured to accept an input of a value from a physical item, such as a currency bill, a coin, a ticket, a voucher, a coupon or a card or other computer-readable storage medium. In one aspect, each player station 120*a*-120*d* comprises an intuitive betting interface fund a player's wagering game play via a secure channel interfacing with a wallet service. The ergonomic design of the player stations 120*a*-120*d* of FIG. 4A, in particular, provide for a relatively small floor footprint for the wagering game machine 102, yet provide for player comfort, privacy, and security at the table. The wagering game machine 102 table is a form factor that advantageously provides comfort and unfettered space while preventing any interference in game control by other players. In various other embodiments, the wagering game system 100 and/or wagering game machine 102 may comprise any number of player stations (e.g., two player stations, three player stations, etc.).

The wagering game system comprises game-logic circuitry configured to, for each of the plurality of player stations (e.g., 120*a* in FIG. 4A) detect, via at least one of the one or more electronic input devices, a physical item associated with a monetary value that establishes a credit balance for the player station (e.g., 120*a*), initiate the casino wagering game at the player station in response to an input indicative of a wager covered by the credit balance (see, e.g., FIG. 3). FIG. 5 shows an example of a display 130*a* for a player station 120*a*, the display including an array 140 (e.g., reels 140*a*-140*c*) indicating a randomly determined outcome of the wagering game conducted at the player station, an indicator (e.g., an icon or game token) 145 used to represent a player's station in the community game 115 (a portion of which is shown in FIG. 5B) and a multiplier color and level (e.g., "Pink" and "×3" in the example depicted in FIG. 5B) that may be applicable to the community game in association with the player's station. Yet other fields 155 in the display are provided for wagering game related information (e.g., credits, lines wagered, line bet(s), total bet, etc.) and/or wagering game inputs (e.g., soft keys for placing a wager, spinning reels, viewing a pay table, accessing a help screen, or providing a cashout input for the player station that initiates a payout from the credit balance for the player station, etc.).

Figure 6A:
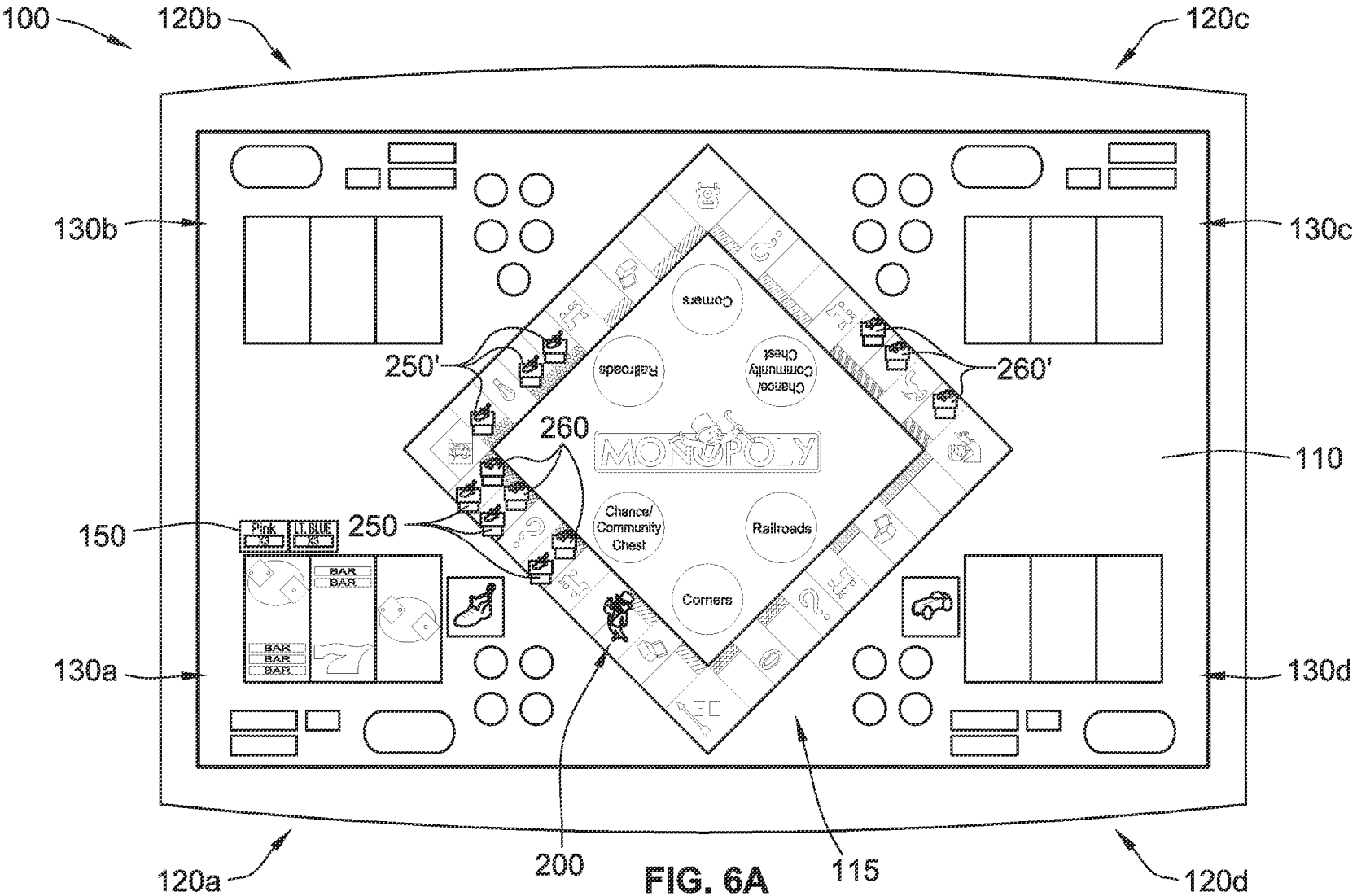
FIG. 6A shows at least some aspects of a community game conducted on a table-based embodiment of the wagering game system depicted in FIG. 4A in accord with at least some aspects of the present concepts.

A top down view of the wagering game machine 102 display 110 is shown in FIG. 6A, which also shows the player stations 120*a*-120*d* relative to the community game 115 display. General details of the player station 120*a* are shown for illustration and are not shown for the remaining player stations 120*b*-120*d*, which are omitted for simplicity. In the illustrated embodiment, the player stations 120*a*-120*d* are provided in each corner of the wagering game machine 102 facing the long edge of the display with each player station having various player meters (e.g., bonus meter, etc.) conveying game-related information, player inputs (e.g., player GUI) and a reel-based wagering game (e.g., a 3-reel, 9-line slot game). In at least some aspects, side bet and/or progressive game options are optionally provided. In other embodiments, the wagering game machine 102 and display(s) 110 may assume a rectangular (as shown), triangular, square, pentagonal, hexagonal, or other form factor to host varying numbers of player stations.

In FIG. 6A, the community game 115 comprises a standard MONOPOLY® board disposed centrally in the table 112. Mr. Monopoly 200 indicates the position of the token for awarding Roll bonuses, discussed below. In accord with at least some aspects of the present concepts, each square has a different associated prize event. For example, color group properties each award one free spin, to be played on the center reel, with each color having an associated free spin feature (e.g., multipliers, wilds, stacks, etc.). Chance and Community Chest award a card pick for a credit prize or other benefit and Free Parking awards a pick from a field with a chance (related to bet) to trigger a JACKPOT Wheel. Railroads spin a prize wheel, following which spin, a train drives around the path of the board and stops on a random game element, awarding an award or event to a player or player having and entry on that game element. If Mr. Monopoly lands on multiple railroad game elements during a ONCE AROUND bonus (e.g., READING RR followed by any one or more of PENNSYLVANIA RR, B&O RR and/or SHORT LINE RR), each successive railroad will award better opportunity for awards (higher expected value) than the prior railroad award. Free Parking awards a pick from a field with a chance, related to the bet, to trigger a JACKPOT reel.

Utilities (i.e., water and electric) multiply a prize by the dice roll or other random event that moved Mr. Monopoly 200 to such utility (e.g., credit value multiplied by 1 or 2 dice from the roll that moved Mr. Monopoly to the utility, further modified should the player station be associated with an entry on the utility). GO awards a pick with a chance of a ONCE AROUND bonus. Luxury Tax, Income Tax, Jail, and Go to Jail award credits. Thus, in this non-limiting example, every game element in the community game 115 confers a benefit to the players of the community game.

In one base wagering game in accord with at least some aspects of the present concepts, two betting modes are provide (1) an EZ BET base bet for the 9 lines (40 credits) and (2) a bonus bet (e.g., 50% more than the EZ BET, a fractional or whole number multiple of the EZ BET, etc.) providing an opportunity not only for increased coins, but also colored reels that provide particular triggers to the community event discuss further hereinbelow. In the examples depicted, the reels bear, for purposes of illustration and not limitation, symbols of DICE, 7s, BARS (single, double, triple), CHERRIES, LOGO, JACKPOT and the like. Certain combinations of symbols (e.g., three CHERRIES, three 7s, etc.) occurring along active paylines are denoted as winning outcomes and credits are awarded for such winning outcomes in accord with a pay table associated with the wagering game and relative to the amount wagered along the payline. Certain other outcome or combinations (e.g., a single symbol displayed in any symbol position on any reel, two scattered symbols, three scattered symbols, etc.) serve as triggering events in relation to the community game. For example, 3 full reels of JACKPOT multiplier award a spin on the JACKPOT Wheel, two scattered DICE symbols award a "Roll" bonus and three scattered DICE symbols award the "ONCE AROUND" bonus, explained hereinbelow. Alternatively, any of the triggering events may comprise a mystery trigger.

Figure 5A:
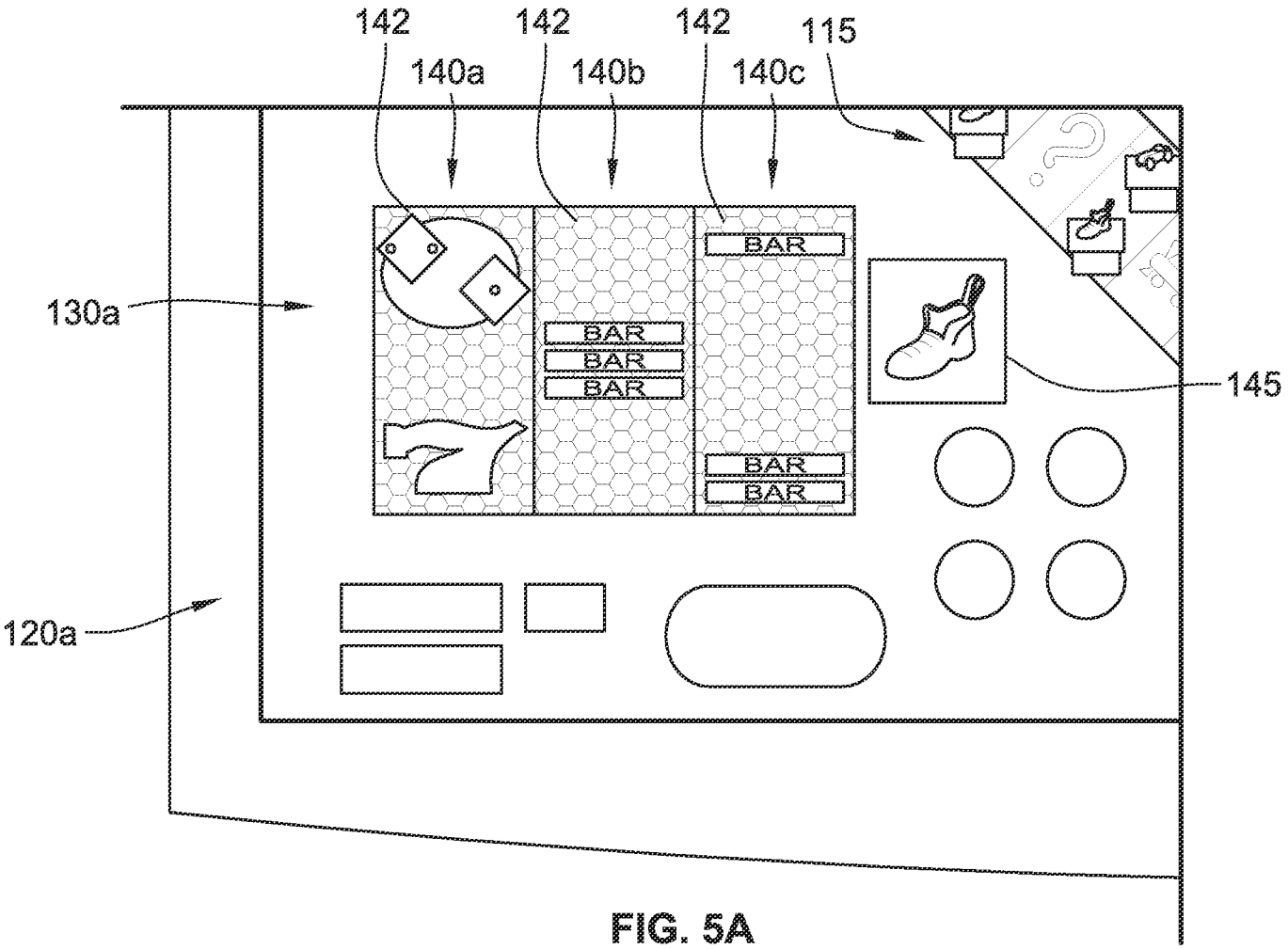
FIG. 5A shows an example of an outcome on a player station display for the table-based embodiment of the wagering game system depicted in FIG. 4A, particularly highlighting the relation between an inner reel strip or watermarking and an outer reel strip bearing wagering game symbols in accord with at least some aspects of the present concepts.
Figure 5B:
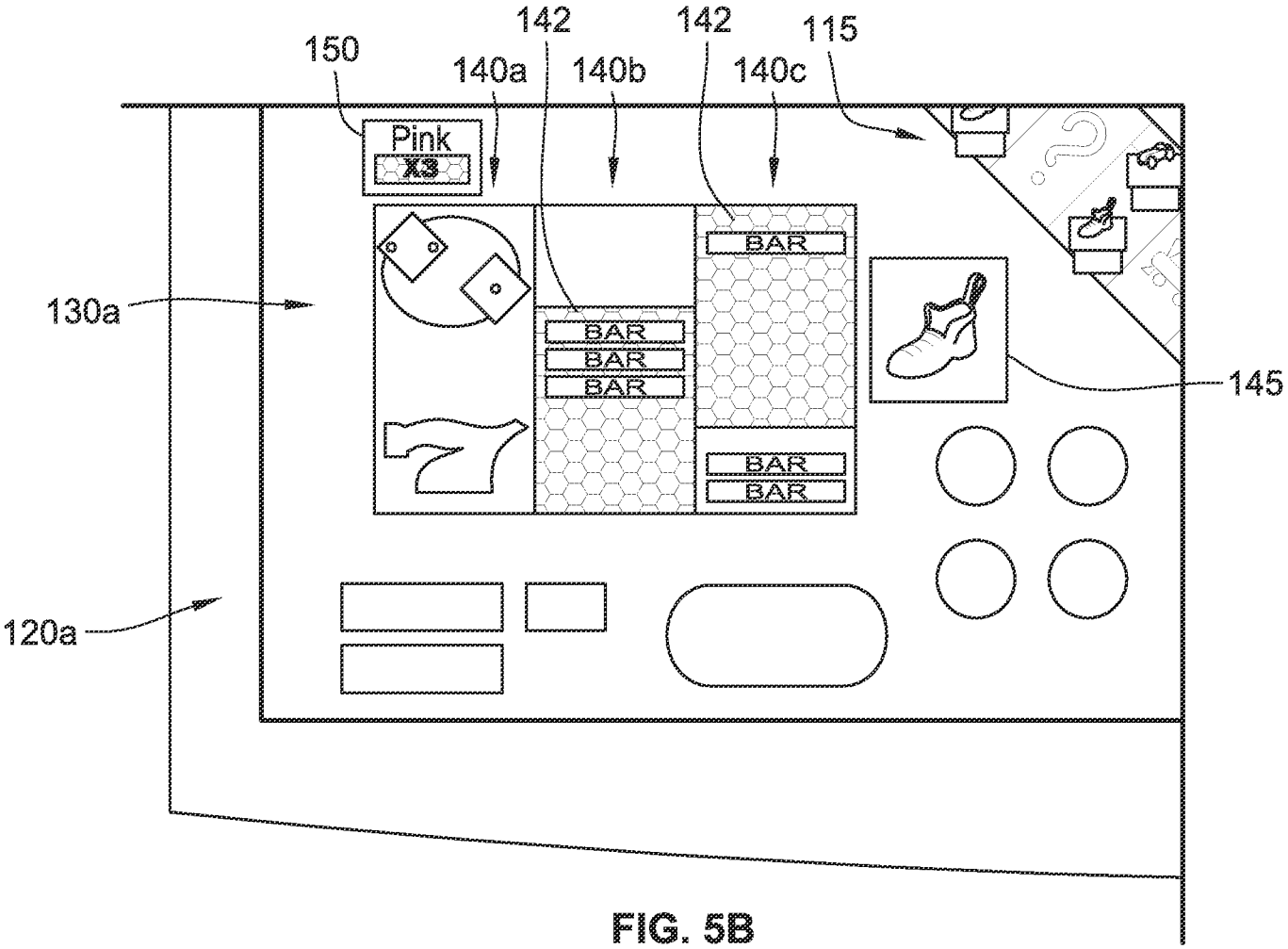
FIG. 5B shows another example of an outcome on a player station display for the table-based embodiment of the wagering game system depicted in FIG. 4A.

In accord with at least some aspects of the present concepts, shown in FIGS. 5A-5B, the reels 140*a*-140*c* may comprise a first reel strip, or inner reel, comprising long clumps of color backgrounds 142, or other background indicia, occupying a plurality of symbol positions, and a second reel strip, or outer reel, comprising symbols 141 (e.g., the aforementioned symbols, etc.) distributed along the symbol positions of the reel strips 140*a*-140*c*. Alternatively, instead of overlapping reel strips, integration of the color backgrounds 142 (or other indicia or background indicia) with the symbol-bearing reel strips to provide an opportunity for awarding of an entry in the community game may be implemented by, for example, integrating a watermark or community-game-related-indicia with each symbol position or by providing a separate reel or indicator (e.g., wheel, etc.) to display a community-game-related-indicia (e.g., color, etc.) at a frequency consistent with the game math and range of expected values required for the wagering game. In yet another aspect, the conventional reel strip for the wagering game may be duplicated n-number of times (n being an integer) in correspondence with n−1 background colors to provide either a colored background or a non-colored background in accord with a wagering game outcome.

In the example of FIGS. 5A-5B, relating to a MONOPOLY®-themed community game 115, clumps of color backgrounds are provided in relation to each reel strip 140*a*-140*c* (e.g., colors occupying a plurality of positions on a reel strip) correspond to the colors of the various properties or game stations of a MONOPOLY®-themed game, namely PURPLE, LIGHT BLUE, MAGENTA/PINK, ORANGE, RED, YELLOW, GREEN, and DARK BLUE. Additional colors or indicia may optionally be added to correspond to additional features of the community game (e.g., a color selected to represent for a JACKPOT or other community game feature, etc.). These color backgrounds, as noted above, may be provided, for example, as a separate reel strip overlaid by the symbol-bearing reel strip or as a part of a larger reel strip integrating the background color and symbols. However implemented, when the reels 140*a*-140*c* are spun to conduct the wagering game associated with the MONOPOLY®-themed community game 115, both a symbol outcome and a color outcome are randomly determined and displayed by the wagering game controller.

Figure 6B:
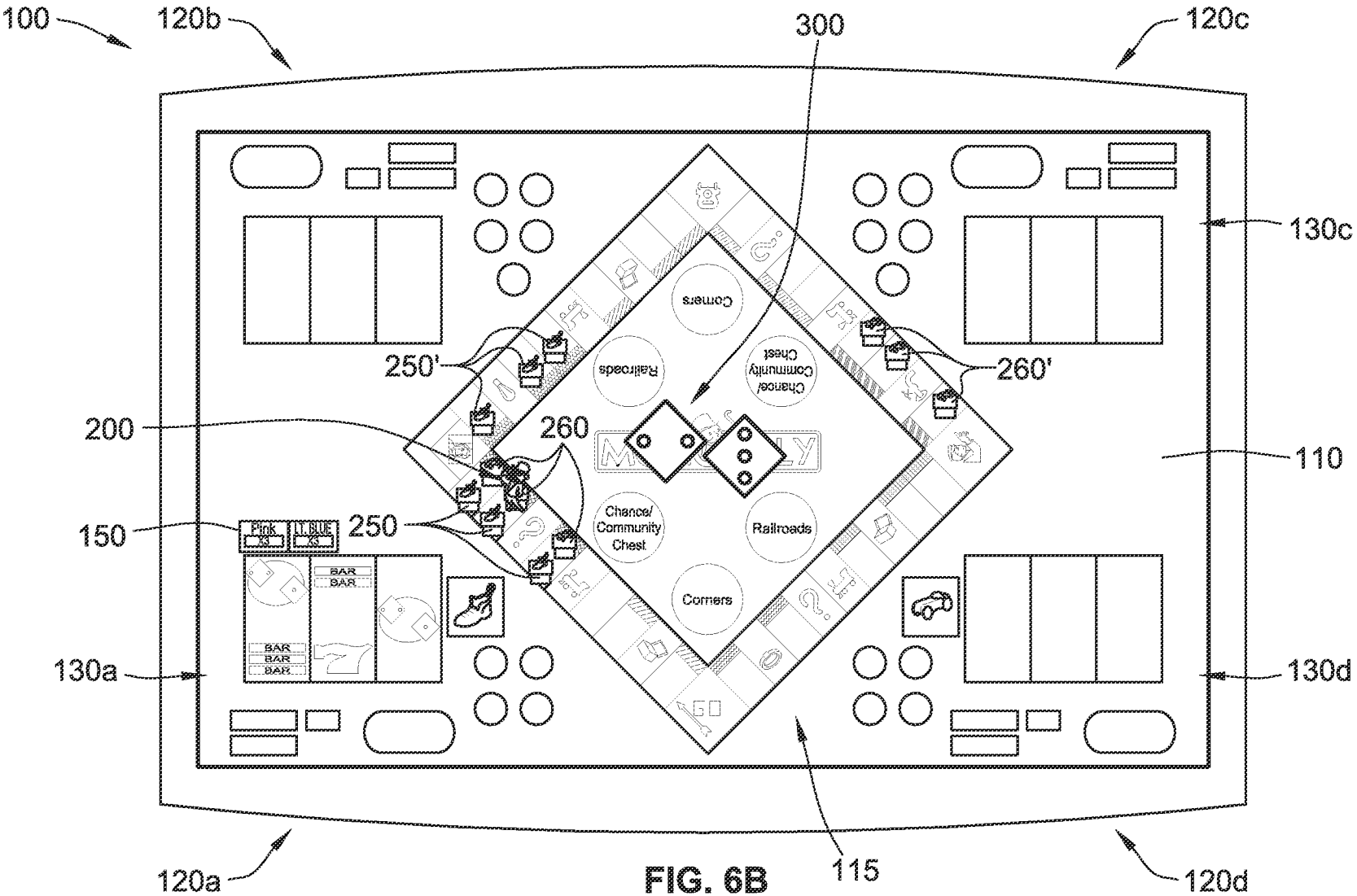
FIG. 6B shows at least some aspects of a community game conducted on a table-based embodiment of the wagering game system depicted in FIG. 4A in accord with at least some aspects of the present concepts.

In the example of FIG. 5A, the reel 140*a* shows an example of a hypothetical first spin showing (from top down) a DICE symbol with a PINK background, a BLANK symbol with a PINK background, and a 7 symbol with a PINK background. Reel 140*b* shows (from top down) a BAR-BAR symbol with a PINK background, a BLANK symbol with a PINK background, and a DICE symbol with a PINK background. Reel 140*c* shows (from top down) a BLANK symbol with a PINK background, a DICE symbol with a PINK background, and a BLANK symbol with a PINK background. Thus, the example of FIG. 5A shows that the reels 140*a*-140*c* display not only symbols 141 corresponding to the wagering game outcome, but also display a background color 142 (PINK) occupying all displayed symbol positions of the reels. In at least some aspects of the present concepts, three full reels of an indicia awards an entry to the player station in association with one or more game elements having the indicia. Thus, in the MONOPOLY®-themed community game 115, nine symbol positions in a 3×3 array occupied by the color PINK awards an entry (e.g., a MONOPOLY® house) to the player station (e.g., 120*a*) in association with one or more game elements (e.g., MONOPOLY® properties) corresponding to the indicia (e.g., the color PINK of St. Charles Place, States Ave., Virginia Ave.). As is shown in FIG. 6A, a house 250' bearing the player-station-specific indicator 145 (e.g., MONOPOLY® game token of "boot") visually associated therewith is disposed on each of the PINK properties (i.e., St. Charles Place, States Ave., Virginia Ave.) responsive to the outcome shown in FIG. 5A at the player station 120*a*. FIGS. 6A-6B also show in the community game 115 that the player-station-specific indicator 145 of player station 120*a* (i.e., the "boot" as shown in FIG. 5A) is visually associated with houses 250 on each of the LIGHT BLUE properties (i.e., Oriental Avenue, Vermont Avenue, Connecticut Avenue), indicating a recent award of an entry associated with the indicia of LIGHT BLUE in a prior wagering game at that player station.

FIG. 5A shows, in indicator 150, a set of game elements (e.g., a color of properties in a MONOPOLY®-themed community game) to which an entry in the community game 115 (e.g., a house in a MONOPOLY®-themed community game) is currently applied. The indicator 150 also shows a bet multiplier level corresponding to a wager level for the wagering game that triggered the generation of the entry. In at least some aspects of the present concepts, the bet multiplier is 1× if the wager is 40 credits, 2× if the wager is 80 credits, 3× if the wager is 120 credits, and so on. Thus, in the example of FIG. 5A, the player places a wager of 120 credits (not shown) and is awarded entries into the community event in relation to the PINK properties (the entries existing for a limited number of plays of the community game). These entries are associated with a 3× multiplier so that any awards occurring in relation to those properties during the limited number of plays in which the entries exist, the player would realize any award arising from such properties, as modified by the player's bet multiplier. If the entries were to exist for seven plays (e.g., ROLL bonuses) of the community game and the same player received, in the next wagering game at the same wager level, another outcome awarding entries into the community event in relation to the PINK properties (the entries existing for a limited number of plays of the community game), the player would then have a 6× multiplier on the PINK properties for the next six rounds and a 3× multiplier for the seventh play of the community game (following the termination of the initial entries).

In general, in response to a triggering event at the player station, the wagering game system 100 awards an entry to the player station in the community game, such entry benefitting the player during play of the community game. It at least some aspects of the present concepts, not only is an entry awarded to the player station in association with one or more game elements in the community game, but such entry in the community game is associated with a multiplier value equal to a current bet multiplier.

In accord with at least some aspects of the present concepts, the entry persists in association with the game element in the community game for a plurality of plays of the community game. In the example of the MONOPOLY®-themed community game 115, the entries shown in association with the player station 120*a* (i.e., the houses 250 and 250' in FIGS. 6A-6B) are each associated with a limited life defined by a predetermined plurality of plays of the community game 115, as further described herein. The game-logic circuitry conducts a play of the community game 115 in response to a community game triggering event occurring during play of the wagering game at a player station. In at least some aspects of the present concepts, the community game triggering event comprises two scattered DICE symbols occurring in the wagering game (e.g., FIG. 5A shows one DICE symbol 141 on reel 140*a* and FIGS. 6A-6B show three scattered DICE symbols on reels 140*a*-140*c* of player station 120*a* display 130*a*), which initiates a ROLL bonus. In some aspects, the ROLL bonus provides a player at the respective player station triggering the ROLL bonus with an opportunity to press a button or soft key to roll two standard dice (i.e., a random event producing an outcome between and including 2-12). Responsive to the outcome of that roll of the dice, or the like, in the community game 115, Mr. Monopoly 200 moves, from a current position, along the board a number of positions corresponding to the roll, or the like, and the wagering game system 100 awards the player station whatever bonus is associated with the square on which that Mr. Monopoly lands. When Mr. Monopoly 200 lands on a property, any player having an entry (e.g., house 250, house 250' in the example of FIG. 6A) on that property (or optionally on the color group of that property) is awarded the award associated with that property. In at least some aspects, a potentially greater award may be awarded to a player station triggering the ROLL bonus, corresponding play of the community game 115 and movement by Mr. Monopoly, if Mr. Monopoly lands on a property having an entry (e.g., a house in the example shown) associated with that player station or, optionally, lands on a property having the color group of a property associated with that player station.

In at least some aspects of the present concepts, the game-logic circuitry is configured to award an award to one or more of the player stations 120*a*-120*d* in response to a play of the community game 115 resulting in an outcome relating to a game element to which one or more entries (e.g., Monopoly house) are applied in association with one or more player stations (e.g., Mr. Monopoly 200 lands on a Monopoly property occupied by one or more houses or one or more players, etc.). For example, in FIGS. 6A-6B, which show an example of a ROLL bonus in the community game 115, player station 102*a* ("boot") and player station 102*d* ("car") already have entries on the LIGHT BLUE properties of Oriental Avenue, Vermont Avenue and Connecticut Avenue. In FIG. 6A, Mr. Monopoly 200 is shown to occupy Baltic Avenue. In FIG. 6A, the player station 120*a* achieves two scatter dice symbols (see display 130*a*) triggering a ROLL bonus. Then, player station 102*a* is presented an opportunity to "roll" a pair of dice. In FIG. 6A, if the player rolls a 2, 4 or 5, both player stations 102*a* and 102*d* will receive an award relating to the presence of entries (250 for player station 120*a* and 260 for player station 120*d*) on the property LIGHT BLUE properties that would then be occupied by Mr. Monopoly 200. In some aspects, the player that rolls in such a ROLL Bonus and has one or more entries on the property on which Mr. Monopoly lands will receive a greater award than the other player(s) having one or more entries on the property. As shown in FIG. 6B, the dice show a ROLL bonus roll of 5 and Mr. Monopoly 200 advances from Baltic Avenue 5 spaces to land on VERMONT AVENUE, on which are disposed an entry 250 for player station 120*a* and an entry 260 for player station 120*d*. Both player station 120*a* and player station 120*d* are awarded for their respective entries, which may be the same or may be different, and which may separately be modified by any multiplier to which a respective player station is entitled based on a wager level in the base game that triggered the entry.

Figure 7A:
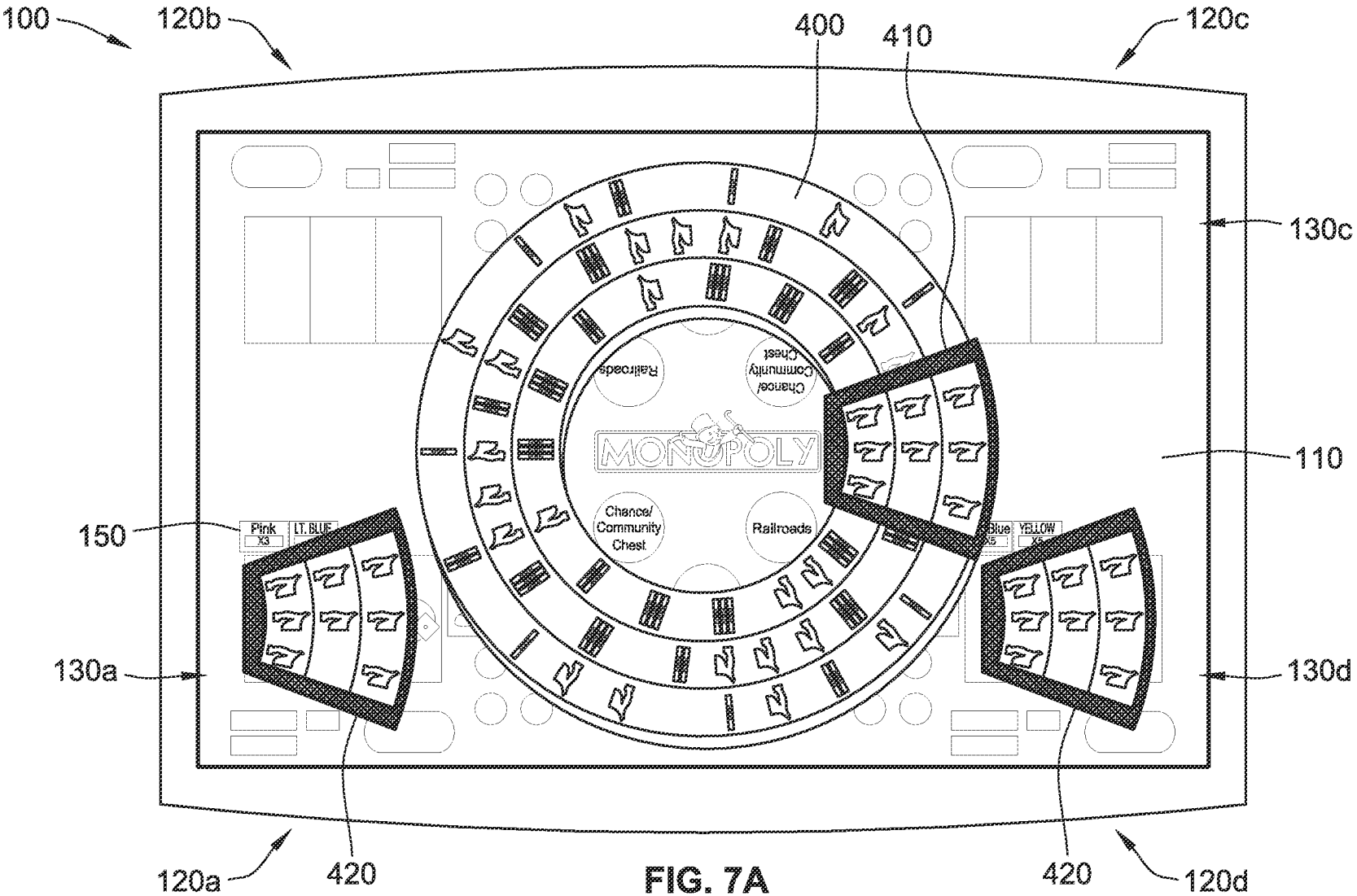
FIG. 7A shows at least some aspects of a community game conducted on a table-based embodiment of the wagering game system depicted in FIG. 4A in accord with at least some aspects of the present concepts.

While the award for FIG. 6B could simply comprise a monetary award, FIG. 7A shows an example of one type of award that could optionally be associated with a property, such as the LIGHT BLUE property (VERMONT AVENUE in FIG. 6B) landed on by Mr. Monopoly 200. As shown in FIG. 7A, giant circular reels 400 appear, with optional alterations based on to property to which this giant reel feature is attached (e.g., LIGHT BLUE properties trigger one spin on reels 400 with extra 7s provided, whereas, for example, DARK BLUE properties may trigger a plurality of spins on the reels with yet more 7s provided). It is to be noted that the giant circular reels 400 are but one possible representation of such a bonus event and the manner of presentation of the random outcome may be represented in another manner, such as but not limited to a conventional reel display (e.g., akin to the reels 82 in FIG. 3 or of the reels 140*a*-140*c* on FIG. 5A, etc.). Thus, the award feature presented to the player stations impacted by the ROLL bonus turn may vary from game element to game element or game element grouping to game element grouping. As shown in FIG. 7A, the player station triggering the ROLL bonus (i.e., player station 120*a* in FIG. 7*a*) and any players who have entries on those game elements (i.e., both player station 120*a* and 120*d*) have the operative part of the giant circular reels 400 duplicated on their displays (i.e., displays 130*a* and 130*d*, respectively). During this event, other players (i.e., player station 120*b* and 120*c* in FIG. 7A) may continue to play their wagering games. In the example shown, 3-7s are shown to align along the horizontal (i.e., 7-7-7) indicating a winning outcome relative to a paytable, such as the wagering game paytable.

In another embodiment of the giant circular reels 400 ROLL bonus, each player participating in the ROLL bonus (e.g., player stations 120*a* and 120*d* in FIG. 7*a*) does not share a common operative part of the giant circular reels 400, but rather has their own assigned 3×3 annular arcs or quadrants of the reels corresponding to their player station. Thus, the 3×3 annular arc of the giant circular reels 400 associated with a first player station (e.g., 120*a*) will be a different annular arc of the giant circular reels associated with a second player station (e.g., 120*d*) such that each player station is provided with a different outcome. In such an embodiment, the symbols would be equally weighted to ensure fairness.

As previously noted, every game element in the community game is advantageously associated with an award or game feature leading to an award, of which the "Added 7s" game reel shown in FIG. 7A is but one example. In various other examples, similar giant circular reels 400 (or other manner of representation of a random event) may be provided for other colored game element groupings with different modifications (e.g., for MAGENTA, WILDS can be added to the reels; for RED, half of 2 of the reels are WILD, etc.). These modifications to the giant circular reels 400, or other bonus event representation of a random game outcome, can advantageously vary from game element to game element. Moreover, for the MONOPOLY®-themed community game 115 wherein the "value" of the game elements increases with distance along the path of the board game from GO to, ultimately, BOARDWALK, so too may the general expected value (EV) of the bonus events for each game element along the path. For example, PURPLE game elements may be provided with a bonus event having a 3× multiplier, LIGHT BLUE game elements may be provided with a bonus event having Added 7s (as noted above), MAGENTA game elements may be provided a with bonus event having Added WILDS on the reels (as noted above), ORANGE game elements may be provided with a bonus event having a 5× multiplier, RED game elements may be provided with a bonus event having half of 2 of the reels as WILD, YELLOW game elements may be provided with a bonus event having one reel as a full WILD reel with a payout being provided at a 3× multiplier, etc., with DARK BLUE game elements being provided with a bonus event having a 25× multiplier. Thus, the content of the bonus event optionally, but advantageously varies for each game element.

As previously noted, each entry in the community game 115 persists for a plurality of plays of the community game, after which time the entry, and the benefit or potential benefit conferred thereby disappears. In some aspects, the plurality of plays of the community game defining the lifespan of the entry are predetermined and uniform. For example, all entries last for a predetermined number of ROLL bonuses (e.g., three ROLL bonuses, four ROLL bonuses, five ROLL bonuses, six ROLL bonuses, seven ROLL bonuses, etc.). Advantageously, a visual indication of the entry may change as the entry nears the end of its useful life. For example, if an entry lasts for seven ROLL bonuses, it may begin to blink slowly after the fifth ROLL bonus and blink quickly after the sixth ROLL bonus whereupon, after the seventh ROLL bonus, that entry disappears. In another aspect of the present concepts, the duration of the entry may comprise a variable value, such as a mystery value selected within a range of permissible values, or a value that is proportional to a level of risk assumed by the player of the wagering game at the player station triggering the outcome generating the entry (e.g., higher levels of wagers can enable entries having correspondingly longer lives, measured in plays of the community game). Thus, a first level of wager above a certain minimum threshold may produce, upon achievement of the entry-triggering outcome, an entry having a life of four plays of the community game, whereas a second level of wager (higher than the first level) may produce an entry having a life of five plays of the community game and a third level of wager (higher than the second level) may produce an entry having a life of six plays of the community game. As yet another example, a life of the entry may be randomly determined.

In yet other aspects of the present concepts, the life of the entry in the community game 115 is specific not to a group of game elements (e.g., all LIGHT BLUE properties consisting of Oriental Avenue, Vermont Avenue and Connecticut Avenue), but rather to a specific game element (e.g., only Vermont Avenue). In such aspects, the entry may be optionally longer-lived than a corresponding larger grouping (e.g., ten plays of the community game, vs. 5-7 plays of the community game for a grouped entry, etc.) or prizes may be optionally enhanced for that game element in view of the lowered probability of an award event in the community game. Further, in such aspects of the present concepts, the game element to which the entry is applied may optionally depend upon, or be related to, the particular outcome that produced the entry. For example, individual game element symbols, such as "BOARDWALK," and the like are populated on the reel strips and serve as an indicator of where the entry is to be placed, either singly or in combination with other triggers (e.g., the color background on the reel strip bearing the game element symbol (e.g., "DARK BLUE") corresponds to the game element symbol (e.g., "BOARDWALK")).

In still other aspects of the present concepts, the award of an entry might not simply to a single game element, or a narrow set of game elements (e.g., game elements of a common color in a MONOPOLY®-themed community game), but rather a plurality of sets of game elements (e.g., game element sets of a plurality of different colors in a MONOPOLY®-themed community game), up to and including all game elements or any combination of game elements without limitation. In some aspects, such entry may only have a lifespan measured by a single play of the community game. In other aspects, such entry may have a lifespan measured by a plurality of plays of the community game.

In still additional aspects of the present concepts, the life of the entry in the community game 115 may be time-based, rather than play-based, such time being predetermined or variable generally in similar respects to that of the play-based entry lifespan paradigm discussed above.

Figure 7B:
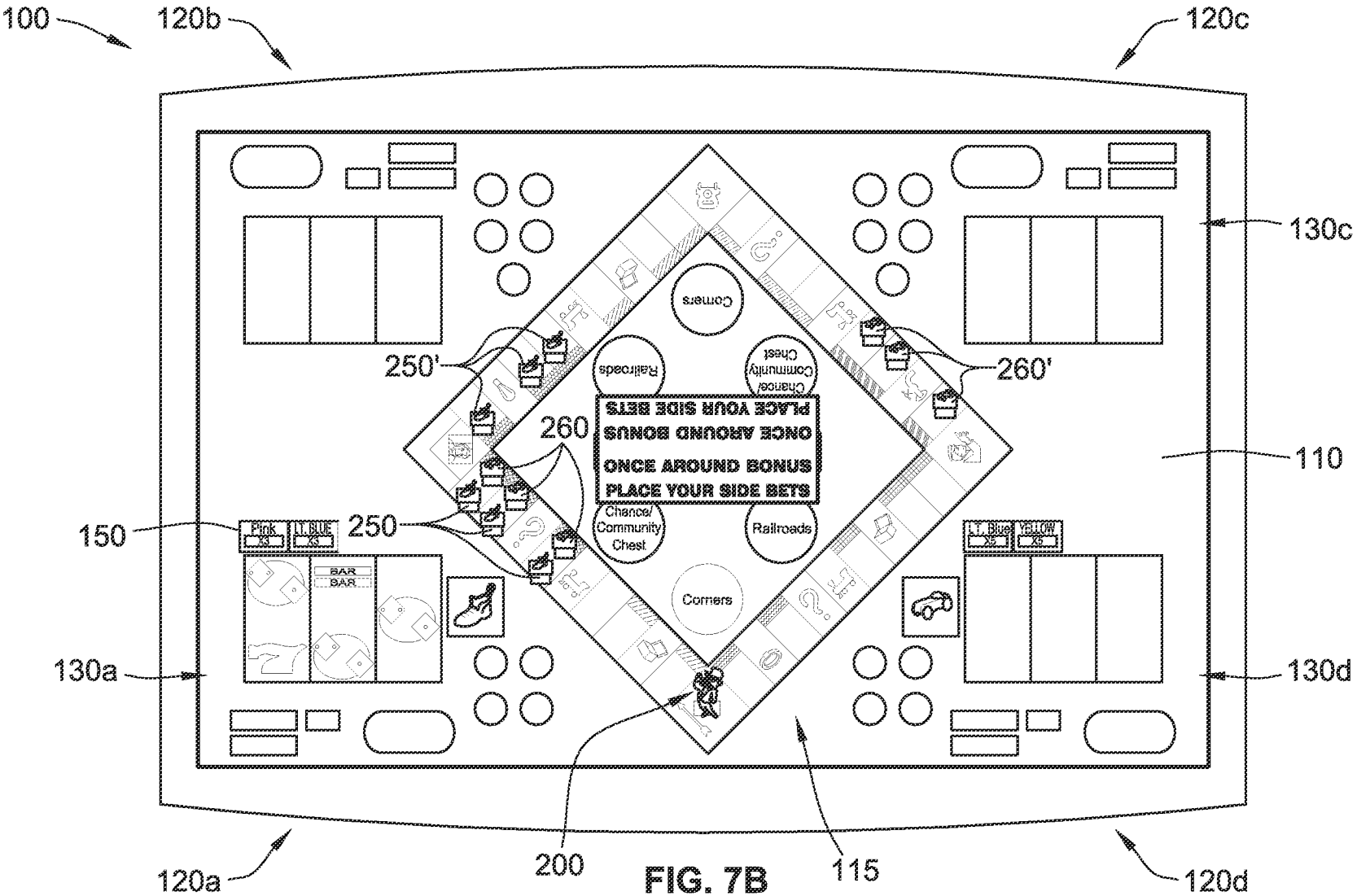
FIG. 7B shows at least some aspects of a community game conducted on a table-based embodiment of the wagering game system depicted in FIG. 4A in accord with at least some aspects of the present concepts.

FIG. 7B shows an example of a "ONCE AROUND" bonus conducted in the MONOPOLY®-themed community game 115. FIG. 7B shows, via display 130*a*, the wagering game conducted on player station 120*a* yielded three scattered dice symbols, which triggers, in at least some aspects of the present concept, a "ONCE AROUND" bonus. Alternatively, other triggering events (e.g., mystery trigger, other symbols or symbol combinations, etc.) could be selected to trigger the "ONCE AROUND" bonus. At the start of the "ONCE AROUND" bonus, Mr. Monopoly 200 moves to the GO square, after which the player station triggering the "ONCE AROUND" bonus (e.g., player station 120*a* in the example depicted) is permitted to press a button or soft key to initiate a "roll" of two standard dice or initiate another randomized outcome causing the game circuitry to determine and display a value between 2 and 12 inclusive. The game circuitry then displays movement of Mr. Monopoly 200 along the board a number of positions corresponding to the randomly determined roll of the dice, or the like. The player station initiating and conducting the "ONCE AROUND" bonus, here player station 120*a*, is awarded whatever award, bonus or bonus event associated with the game element landed on by Mr. Monopoly. Further, if the game element landed on by Mr. Monopoly is a property having an entry (e.g., a house) on that color group, any player station associated with the entry or entries is also awarded the associated award, bonus or bonus event associated with the game element landed on by Mr. Monopoly, as may be further modified by any modifier (e.g., multiplier) to which the player station may be entitled (e.g., in accord with indicator 150). This sequence continues, with the player station conducting the "ONCE AROUND" bonus (e.g., player station 120*a*) continuing to keep "rolling" dice and Mr. Monopoly 200 continuing to move along the path defined by the board game elements until Mr. Monopoly has landed on or passed GO again, at which time the "ONCE AROUND" bonus ends and Mr. Monopoly returns to his previous position. In at least one aspect of the present concepts, the "ONCE AROUND" bonus does not count against the number of plays for which player entries in the community game 115 persist in the community game. In other words, in such aspects, the "ONCE AROUND" bonus does not diminish the lifespan of the entries in the community game 115.

Figure 8:
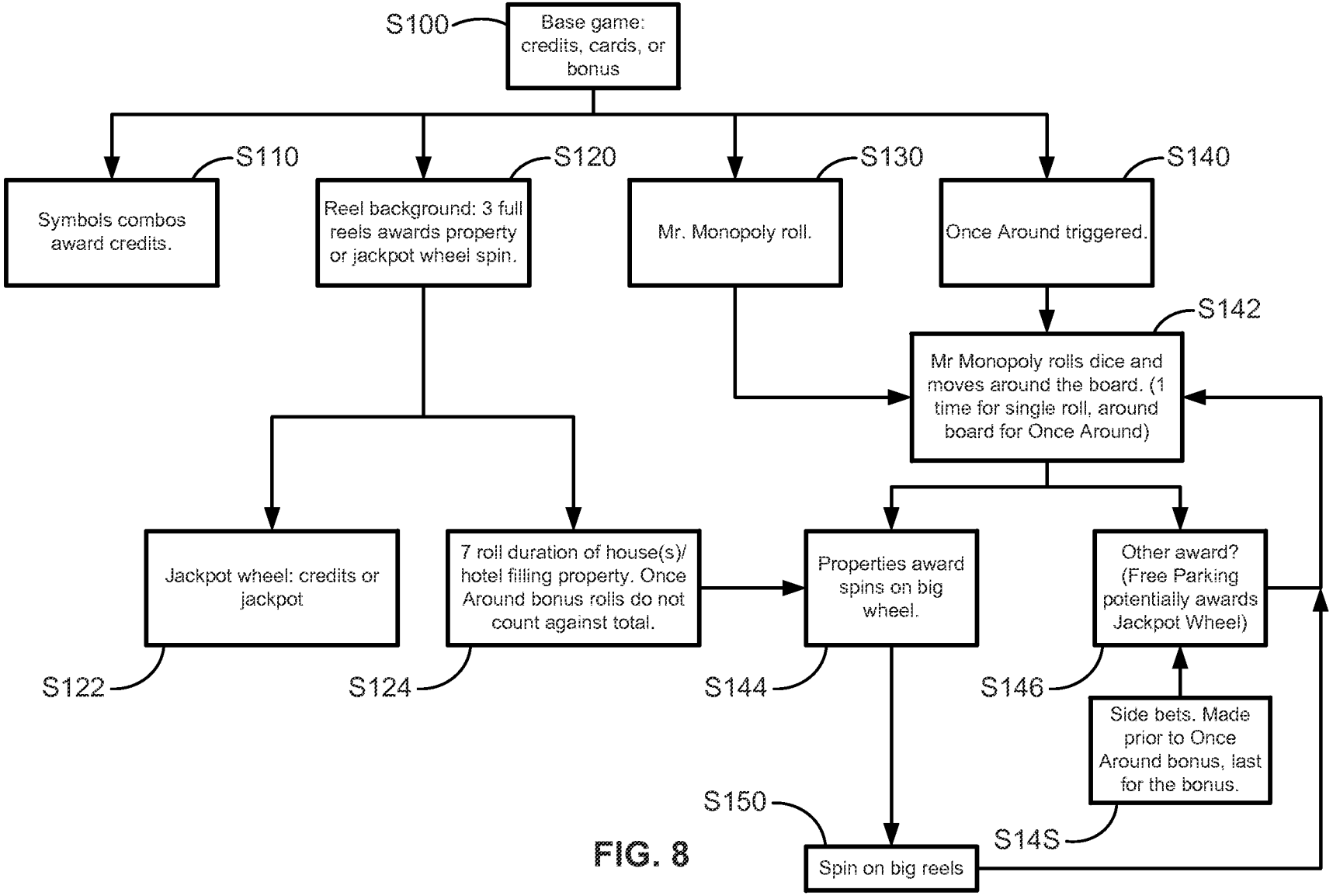
FIG. 8 is a general flowchart for instructions executed by game logic circuitry in accord with at least some aspects of the disclosed concepts.

FIG. 8 shows a general flowchart for instructions executed by game logic circuitry in accord with at least some aspects of the disclosed concepts. In the method represented by FIG. 8, the gaming system includes game-logic circuitry, at least one electronic display device, one or more electronic input devices, and a plurality of player stations (see, e.g., player stations 120*a*-1202 of FIGS. 4A-4B), each player station primarily dedicated to playing at least one respective regulated casino wagering game and configured to participate in a community game (see, e.g., act S100 in FIG. 8). The method implemented by the game logic circuitry is configured to detect, via at least one of the one or more electronic input devices at the respective player station, a physical item associated with a monetary value that establishes a credit balance and to initiate the casino wagering game at the respective player station in response to an input indicative of a wager covered by the credit balance. Further, the method implemented by the game logic circuitry includes, in response to a first triggering event, awarding, by the game-logic circuitry, an entry to one of the player stations and applying, by the game-logic circuitry, the entry to a game element of the community game (see, e.g., act S120 of FIG. 8), the entry persisting with the game element for a plurality of plays of the community game (see, e.g., act S124 of FIG. 8).

In response to a second triggering event (see, e.g., acts S130, S140 of FIG. 8), the game logic circuitry conducts a play of the community game (see, e.g., acts S142, S144, S146, S148, S150 of FIG. 8) and, in response to the play of the community game resulting in an outcome associated with the game element to which the entry is applied, the game-logic circuitry awards an award to the one of the player stations. The method implemented by the game-logic circuitry further includes receiving, via at least one of the one or more electronic input devices of the respective gaming machine, a cashout input that initiates a payout from the credit balance.

In at least some aspects of the present concepts, players are given an opportunity to cash out the expected value (EV) of any entries that they have present in the community game (e.g., houses in a MONOPOLY®-themed community game) when they decide to end their wagering game session.

Each of these embodiments and obvious variations thereof is contemplated as falling within the spirit and scope of the claimed invention, which is set forth in the following claims. Moreover, the present concepts expressly include any and all combinations and sub-combinations of the preceding elements and aspects.

The invention claimed is:

1. A casino wagering game system primarily dedicated to playing a casino wagering game and a community game, the wagering game system comprising:

a first electronic display device configured to display the community game, a plurality of player stations, primarily dedicated to playing the wagering game and the community game, communicatively coupled to the first electronic display device, each player station comprising a second electronic display device and one or more electronic input devices; and game-logic circuitry configured to, for each of the plurality of player stations:

detect, via at least one of the one or more electronic input devices, a physical item associated with a monetary value that establishes a credit balance for the player station;

initiate the casino wagering game at the player station in response to an input indicative of a wager covered by the credit balance to cause the display of a randomly determined wagering game outcome on the second electronic display device;

in response to a first triggering event, award an entry to the player station in the community game;

apply the entry to one or more game elements of the community game in association with the player station, the entry persisting with the one or more game elements for a predetermined number of plays of the community game such that entries earned by the player station at different times in the casino wagering game will have different expiration times, wherein the one or more game elements to which the entry is applied depends upon the first triggering event; and receive, via at least one of the one or more electronic input devices, a cashout input for the player station that initiates a payout from the credit balance for the player station, wherein the game-logic circuitry is further configured to conduct a play of the community game in response to a second triggering event, and wherein the game-logic circuitry is further configured to award an award to any player station having an entry applied to a game element in the community game responsive to an outcome of a play of the community game that is associated with the game element to which the entry is applied, wherein the entry is removed from the game element of the community game following the predetermined number of plays.

2. The casino wagering game system of claim 1, wherein the physical item is selected from a group consisting of a currency bill, a coin, a ticket, a voucher, a coupon, a card, and a computer-readable storage medium, and wherein the one or more electronic input devices comprises at least one of a value input device, touch panel, or physical push-button.

3. The casino wagering game system of claim 1, wherein the first electronic display device comprises an electronic table, and wherein the second electronic display device of each of the plurality of player stations comprises an allocated region of the electronic table.

4. The casino wagering game system of claim 1, wherein the wagering game comprises a reel-based wagering game, and wherein the second triggering event comprises a mystery trigger or a predetermined scattered symbol or symbols in the wagering game outcome.

5. The casino wagering game system of claim 1, wherein the community game comprises a board game defining a plurality of game elements arranged in a path, the plurality of game elements including the one or more game elements, and wherein each player station is associated with a unique board game token movable along the plurality of game elements responsive to a randomly determined outcome associated with the second triggering event.

6. The casino wagering game system of claim 5, wherein the board game comprises designated game elements of the plurality of game elements being associated with one of a plurality of color groupings, and wherein the game element to which the entry is applied depends upon a correspondence between a color grouping denoted by the wagering game outcome that produced the entry and a color grouping of the game element.

7. The casino wagering game system of claim 1, wherein certain plays of the community game in association with the player station do not count against the number of plays for which the entries associated with the player station persist in the community game.

8. The casino wagering game system of claim 1, wherein each entry is associated with one of a plurality of multipliers in correspondence with a level of a wager in a play of the casino wagering game that triggered the entry.

9. The casino wagering game system of claim 1, wherein the first triggering event identifies at least one aspect of the one or more game elements, the at least one aspect comprising at least one of a color, a game element type, or a game element name.

10. A method of operating a gaming system, the gaming system including game-logic circuitry, at least one electronic display device, one or more electronic input devices, and a plurality of player stations, each player station primarily dedicated to playing at least one respective regulated casino wagering game and configured to participate in a community game, the method comprising:

detecting, via at least one of the one or more electronic input devices at the respective player station, a physical item associated with a monetary value that establishes a credit balance;

initiating the casino wagering game at the respective player station in response to an input indicative of a wager covered by the credit balance;

in response to a first triggering event, awarding, by the game-logic circuitry, an entry to one of the player stations;

applying, by the game-logic circuitry, the entry to a game element of the community game, the entry persisting with the game element for a predetermined number of plays of the community game such that entries earned by the player station at different times in the casino wagering game will have different expiration times, wherein the game element to which the entry is applied depends upon the first triggering event;

in response to a second triggering event, conducting a play of the community game;

in response to the play of the community game resulting in an outcome associated with the game element to which the entry is applied, awarding, by the game-logic circuitry, an award to the one of the player stations;

removing, by the game-logic circuitry, the entry from the game element of the community game following the predetermined number of plays; and receiving, via at least one of the one or more electronic input devices of the respective gaming machine, a cashout input that initiates a payout from the credit balance.

11. The method of operating a gaming system according to claim 10, wherein the at least one electronic display device of the gaming system comprises an electronic table display and the plurality of player stations each comprise an allocated region of the electronic table display, or wherein the at least one electronic display device of the gaming system comprises a community game display and the plurality of player stations comprise separate wagering game machines.

12. The method of operating a gaming system according to claim 10, wherein the first triggering event includes an entry-awarding outcome in the casino wagering game at the one of the player stations.

13. The method of operating a gaming system according to claim 10, further comprising:

in response to a third triggering event, conducting a plurality of sequential plays of the community game, wherein the plurality of sequential plays of the community game are not applied, by the game logic circuitry, to the predetermined number of plays of the community game.

14. The method of operating a gaming system according to claim 10, wherein the community game includes a path of spaces traversable by a token, wherein the applying includes applying the entry to one of the spaces, wherein the conducting includes randomly moving the token to one of the spaces, and wherein the awarding is in response to the token landing on the same space occupied by the entry.

15. The method of operating a gaming system according to claim 10, wherein the award awarded in response to the play of the community game is based on a level of wager placed in the wagering game generating the first triggering event.

16. The method of operating a gaming system according to claim 10, wherein the first triggering event identifies at least one aspect of the game element, the at least one aspect comprising at least one of a color, a game element type, or a game element name.

17. A casino wagering game machine primarily dedicated to playing a casino wagering game and a community game, the wagering game machine comprising:

an electronic table display device defining a first portion on which the community game is displayed and defining a plurality of second portions on which the casino wagering game is displayed to a respective plurality of player stations arranged around the electronic table display device, each player station further comprising one or more electronic input devices; and game-logic circuitry configured to, for each of the plurality of player stations:

detect, via at least one of the one or more electronic input devices, a physical item associated with a monetary value that establishes a credit balance for the player station;

initiate the casino wagering game at the player station in response to an input indicative of a wager covered by the credit balance to cause the display of a randomly determined wagering game outcome on the respective one of the second portions of the electronic table display device;

in response to a first triggering event, award an entry to the player station in the community game;

apply the entry to one or more game elements of the community game in association with the player station, the entry persisting with the one or more game elements for a predetermined number of plays of the community game such that entries earned by the player station at different times in the casino wagering game will have different expiration times, wherein the one or more game elements to which the entry is applied depends upon the first triggering event; and receive, via at least one of the one or more electronic input devices, a cashout input for the player station that initiates a payout from the credit balance for the player station, wherein the game-logic circuitry is further configured to conduct a play of the community game in response to a second triggering event, and wherein the game-logic circuitry is further configured to award an award to any player station having an entry applied to a game element in the community game responsive to an outcome of a play of the community game that is associated with the game element to which the entry is applied, wherein the entry is removed from the game element of the community game following the predetermined number of plays.

18. The casino wagering game machine of claim 17, wherein the first triggering event identifies at least one aspect of the one or more game elements, the at least one aspect comprising at least one of a color, a game element type, or a game element name.

* * * * *